US005270722A

United States Patent [19]

Delestre

[11] Patent Number: 5,270,722

[45] Date of Patent: Dec. 14, 1993

[54] PATCH-TYPE MICROWAVE ANTENNA

[75] Inventor: Xavier Delestre, Paris, France

[73] Assignee: Thomson-CSF, Puteaux, France

[21] Appl. No.: 810,163

[22] Filed: Dec. 19, 1991

[30] Foreign Application Priority Data

Dec. 27, 1990 [FR] France ..... 90 16328

[51] Int. Cl.[5] ..... H01Q 1/38

[52] U.S. Cl. ..... 343/700 MS; 343/828

[58] Field of Search ..... 343/700 MS, 795, 828, 343/829, 846, 893

[56] References Cited

U.S. PATENT DOCUMENTS

| | | | |
|---|---|---|---|
| 4,089,003 | 5/1978 | Conroy | 343/700 MS |
| 4,410,891 | 10/1983 | Schaubert | 343/700 MS |
| 4,500,887 | 2/1985 | Nester | 343/795 |
| 4,918,458 | 4/1990 | Brunner et al. | 343/795 |

FOREIGN PATENT DOCUMENTS

| | | | |
|---|---|---|---|
| 62-15902 | 1/1987 | Japan | 343/700 MS |

OTHER PUBLICATIONS

Patent Abstracts of Japan, vol. 7, No. 107 (E-174) [1252], May 11, 1983, & JP-A-58-29203, Feb. 21, 1983, T. Taga, "Multilayered Microstrip Diversity Antenna". International Symposium, vol. 2, Jun. 26-30, 1989, pp. 628-631, IEEE 1989 International Symposium Digest Antennas and Propagation, San Jose, Calif., US; S. Assailly, et al.: "Low Cost Stacked Circular Polarized Microstrip Antenna".

*Primary Examiner*—Michael C. Wimer

*Attorney, Agent, or Firm*—Oblon, Spivak, McClelland, Maier & Neustadt

[57] ABSTRACT

A radiating element has two superimposed patches separated by a dielectric layer. At least the lower patch has two opposite concave sides to allow space for the feeder conductor to pass to the other patch without increasing the overall dimensions of the element.

14 Claims, 5 Drawing Sheets

PATCH-TYPE MICROWAVE ANTENNA

BACKGROUND OF THE INVENTION

This invention applies to patch-type microwave antennas.

DESCRIPTION OF THE PRIOR ART

Antennas printed onto a dielectric substrate, known as the "patch type" are frequently used in microwave transmission. These patches can be excited by two separate feeders to obtain two different types of propagation patterns from the same radiating element. Generally, the signals applied via the two feeders each generate linearly polarized radiation, the two polarization directions being mutually perpendicular (for example, one vertical and the other horizontal). Careful selection of the amplitude and phase of the two signals also allows circular polarization to be obtained.

The microwave isolation between the two inputs basically depends on the geometrical shape of the patch (printed metal conductor) to which the feeders are connected (either by wire or a coupling circuit).

With electronic sweep antennas, it is difficult to feed the radiating elements in the array when each has two inputs since this requires two microwave energy distribution systems. It is also possible to switch the type of radiation obtained from these antennas. It then becomes necessary to feed each radiating element via a switch with one input and two outputs, the outputs being connected to the inputs to the radiating element. Depending on the electrical control signal and the type of switch used, the radiation obtained may either be linearly polarized (horizontal or vertical) or have circular polarization (left or right).

In the case of electronic sweep antenna arrays, the outside dimensions of the radiating elements used must be smaller than those of the array mesh. This makes it necessary to use a transverse feed to the radiating elements to minimize their overall dimensions. Coaxial lines are used for this purpose, with the central conductors electrically connected to the metal patch. There is, therefore, no direct current isolation between the two inputs to the radiating element.

Known switches used to change from linear to circular polarization and vice-versa comprise one or several diodes connected directly across the two outputs from these switches. These switches will only work if there is DC isolation between their two outputs, which is not the case when these outputs are connected to the two inputs to a patch-type antenna of the type that existed in the prior art.

A known, simple but expensive solution is to connect a capacitor in series between one of the switch outputs and one of the radiating element inputs. This capacitor provides DC isolation but must have negligible impedance to microwave frequencies.

Known bipolarization patch-type radiating elements have two inputs connected directly to a single metal conductor etched on a dielectric substrate. This conductor is known as the "source patch" and is generally square or circular to obtain identical radiation in both polarization directions. To improve the radiating element operating band, one or several other patches, electromagnetically coupled and supported by an insulating material, can be placed above the source patch.

To produce a bipolarized radiating element with two inputs isolated from each other against DC components, the single element could be replaced by two independent single-polarization radiating elements with the two polarizations mutually perpendicular to each other. However, the dimensions of this solution generally make it impractical.

SUMMARY OF THE INVENTION

One object of the invention is to provide a bipolarized radiating element with two inputs isolated from each other against DC components which requires no isolating capacitors and gives the most compact arrangement possible.

The radiating element complying with this invention comprises at least two superimposed patches, isolated from each other by a film of air or a dielectric material, in which two opposite sides of at least the lower patch are concave, a feeder being connected to each of these first two patches and the feeder to the upper patch passing close to a concave side of the lower patch. The two opposed concave sides of the lower patch are virtually parallel to the electric field radiated by the lower patch. This arrangement is the only way to allow the upper patch feeder to be connected without passing through the lower patch.

BRIEF DESCRIPTION OF THE DRAWINGS

The invention will be better understood upon reading the following description of a few non-exhaustive examples of embodiments, illustrated by the appended drawing on which.

DESCRIPTION OF THE PREFERRED EMBODIMENTS

Figure 1:
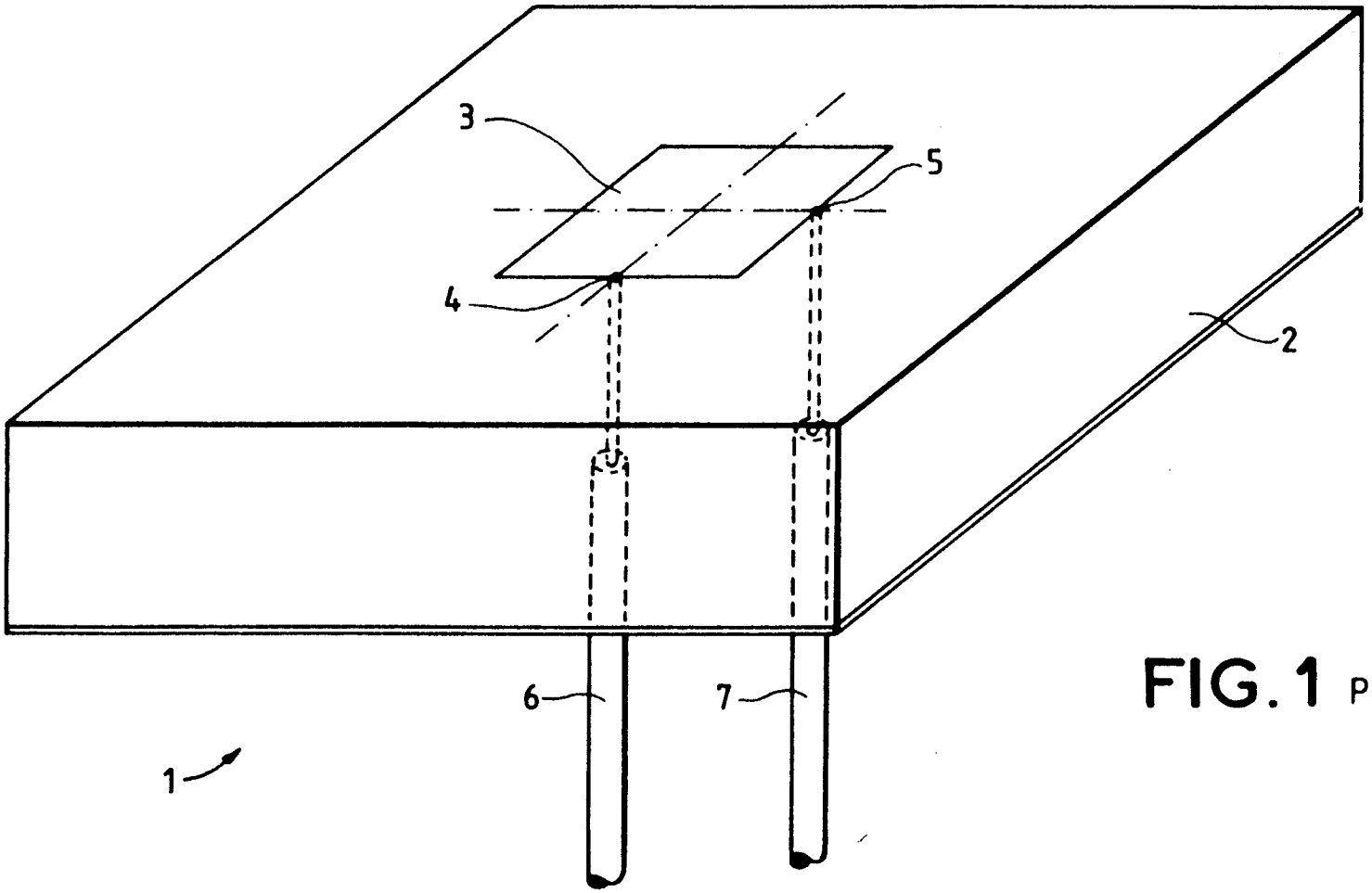
FIG. 1 PRIOR ART
FIG. 1 is a simplified perspective view of a bipolarized radiating element complying with the prior art.

The bipolarized radiating element 1 shown on FIG. 1 consists of a dielectric substrate 2 whose bottom face is almost entirely metallized. One or several, for example square, patches 3 are etched on the top face of substrate 2, which is also metallized. Holes for the patch feed coaxial conductors 6 and 7 are drilled through the substrate 2 and its metallization at the centers 4 and 5 of the two sides of square 3. Conductor 6 gives, for example, vertical polarization and conductor 7 horizontal polarization. As explained previously, capacitors must be connected between the polarization switch and an element of this type to provide DC isolation.

Figure 2:
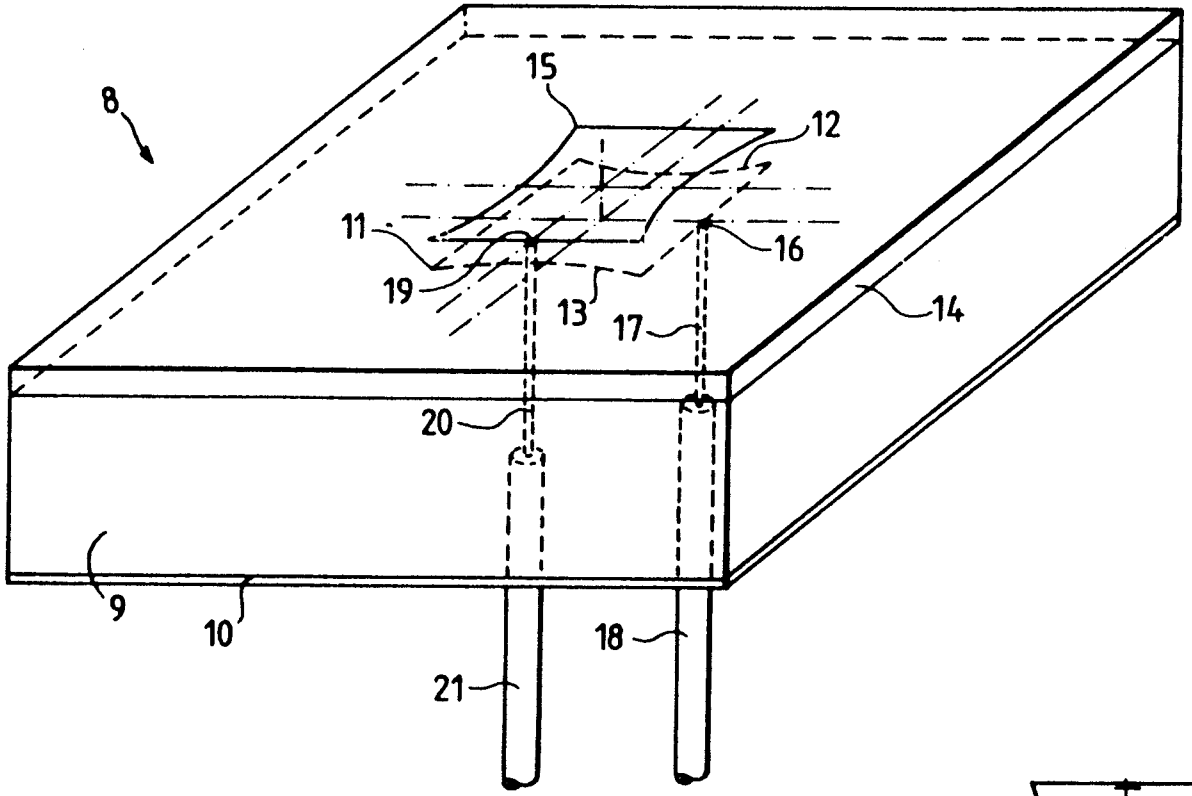
FIG. 2 is a simplified perspective view of a bipolarized radiating element complying with this invention and FIGS. 3(*a*), 3(*b*), 4–8 are plan views of various patches embodying the invention.

FIG. 2 shows a radiating element 8 complying with the invention and basically comprising a support dielectric substrate 9 whose lower face 10 (as shown on the drawing but, in fact, the face opposite the radiating face) is metallized. The upper face of substrate 9 is metallized and then one or several patches (several to obtain an array) are etched on it. The drawing represents one such patch, item 11, only. This patch 11 is almost square in shape but two opposite sides 12 and 13 are slightly concave (deflection F is 10 to 20% of the side of the square, see FIG. 3). These two sides (more precisely, the sides corresponding to the original square) are parallel to the electric field radiated by the element. A solid dielectric 14 is fixed, for example by bonding, to the upper face of substrate 9 (the face on which patch 11 is formed). Dielectric 14 is thinner than substrate 9 (for example, 5 to 10 times thinner). The top face of dielectric 14 is first metallized and then etched to form one (or, in the case of an array, several) radiating element(s) 15 with the same shape and dimensions as element 11. The center of element 15 is on the same axis as that of element 11 but the two elements are rotated 90° relative to each other, i.e. the concave edge of one lies opposite a straight edge of the other.

A hole is drilled through substrate 9 and its metallization at the center 16 of a straight edge of element 11 to allow the core 17 of a coaxial feeder 18 to pass. A hole is drilled through dielectric 14, substrate 9 and its metallization 10 at the center 19 of a straight edge of element 15 to allow the core 20 of a coaxial feeder 21, which feeds element 15, to pass. Because point 19 is above an area of the top face of substrate 9 which is not metallized (since the corresponding side of element 11 is concave) the hole for the core of conductor 21 can be tangential to point 19 (and perpendicular to the surface of dielectric 14 and substrate 9) without any risk of contact between this core and element 11. Consequently, the dimension in a plane perpendicular to the direction of propagation of the radiating element is as small as possible and the array formed can be as dense as possible.

Figure 3A:
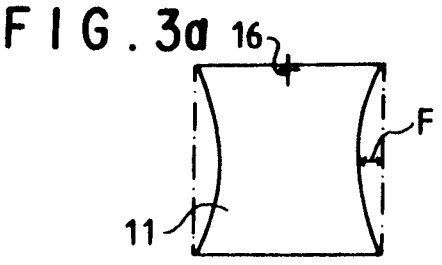
Figure 3B:
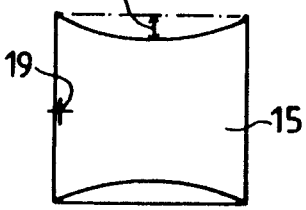
Figure 5:
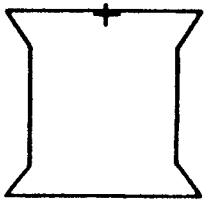
Figure 4:
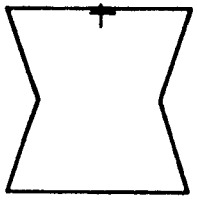

FIGS. 3(*a*) and 3(*b*) show a plan view of elements 11 and 15. Instead of the two opposing sides having a circular concave form, they could also be given, for example, a concave "V" shape as shown on FIG. 4 or a trapezium shape as shown on FIG. 5. However, these are not exhaustive examples of possible shapes and others could be used provided they satisfy the important requirement to delete sufficient material along at least one edge of the lower patch to leave room for the core of the top patch feeder to pass without increasing the dimensions perpendicular to the direction of propagation from the radiating element.

Figure 6:
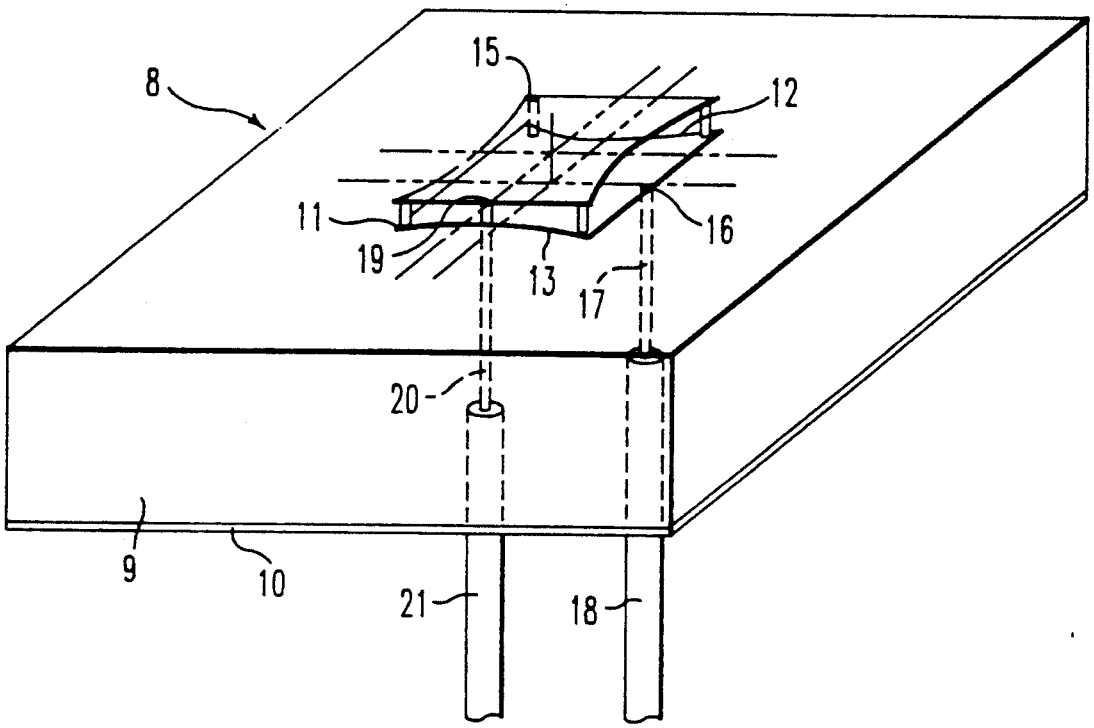

In another embodiment, as shown in FIG. 6, dielectric 14 could be replaced by an air film. In this case, the top patch would be produced using the "suspended triple plate" technique. The top patch would, in fact, be formed on a thin support film mounted on small patches in an insulating material.

Dielectric layer 14 need not necessarily cover the entire surface of substrate 9. It could, for example, include apertures aligned with the concave sides of element 15. This would give easier access to the straight edges of element 18 and, in particular, its feeder connection point 16.

Figure 7:
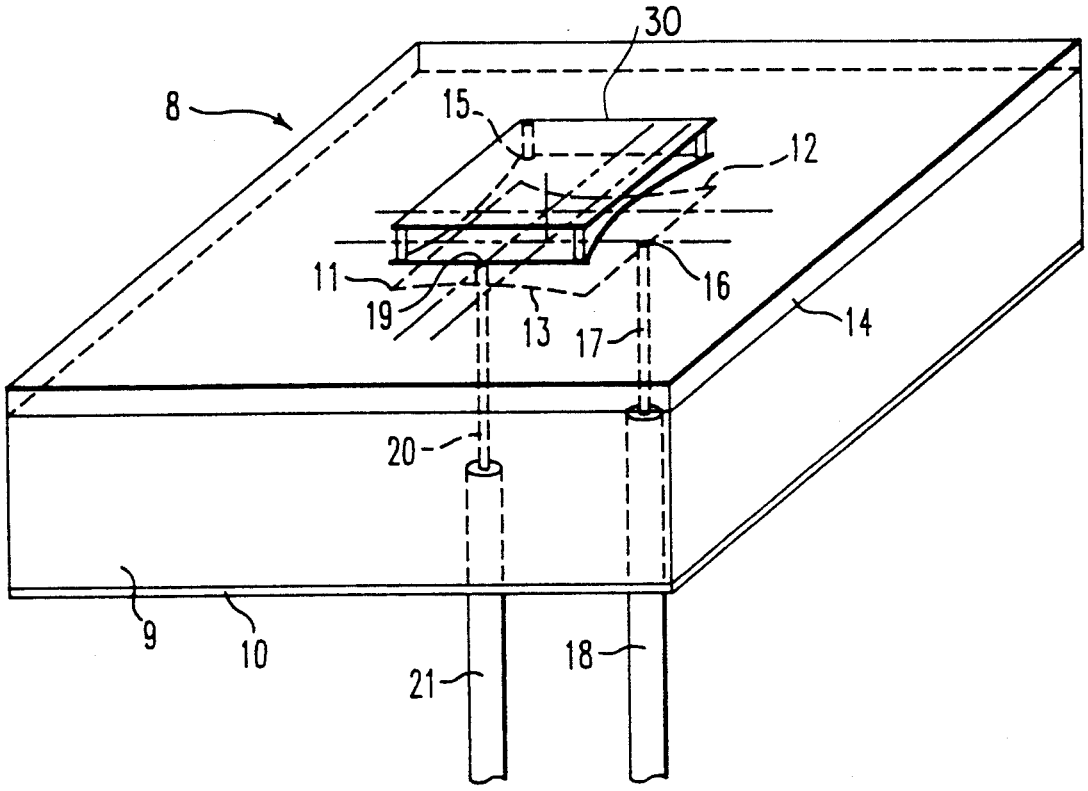

In the same way as for patches complying with the prior art, the passband of an element complying with the invention can be increased by placing other elements 30, not connected by feeders but excited by electromagnetic coupling, above the top element 15, as shown in FIG. 7. These elements can be square, or almost square, and have two opposite concave sides of the same size or smaller than patch 15. These additional elements could also have a different shape to that of patch 15.

In addition to the simplicity with which it can be produced, a radiating element complying with the invention offers the following advantages:

DC isolation between its two inputs;

easy access to the feeder connection points (16, 19) on its two radiating patches;

as far as microwave radiation is concerned, the two elements 11 and 15 are in the same position;

the amplitude reflection factor is similar at input to the two elements;

high microwave decoupling between the inputs to the two elements;

performance similar to that obtained from the original radiating element; in particular, the symmetry is maintained.

Figure 8:
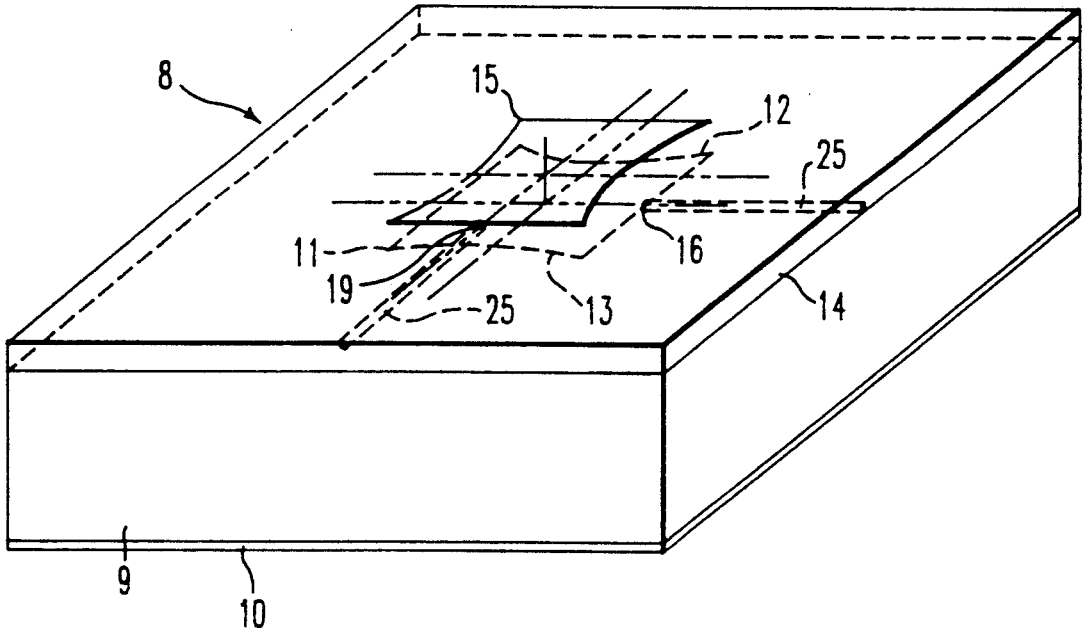

A radiating element complying with the invention can be used in applications such as mono or multi-element active or passive antennas operating with linear and/or circular polarization including, if required, switching between the two. Other types of line, for example microstrips 25, as shown in FIG. 8, could also be used as feeders to the radiating element patches.

What is claimed is:

1. A microwave radiating element comprising:

a first patch having two opposite sides which are concave;

a first feeder connected to the first patch;

a second patch located above the first patch, the second patch having two opposite sides which are concave, the two opposite concave sides of the second patch not being located above the two opposite concave sides of the first patch;

a second feeder connected to the second patch; and means for separating the first patch from the second patch.

2. The microwave radiating element according to claim 1, wherein the means for separating the first patch from the second patch comprises an air film.

3. The microwave radiating element according to claim 1, wherein the means for separating the first patch from the second patch comprises a layer of dielectric material.

4. The microwave radiating element according to claim 1, wherein the first and second feeders are coaxial lines.

5. The microwave radiating element according to claim 1, wherein the first and second feeders are each connected to a center of one of straight sides of the respective first and second patches.

6. The microwave radiating element according to claim 1, wherein the first and second feeders are microstrips.

7. The microwave radiating element according to claim 1, further comprising at least one further patch located above the second patch.

8. A microwave radiating element comprising:

a first patch having two opposite sides which are concave and two opposite sides which are straight;

a first feeder connected to the first patch;

a second patch located above the first patch and having two opposite sides which are concave and two opposite sides which are straight as in the first patch, and being rotated 90° relative to the first patch;

a second feeder connected to the second patch; and means for separating the first patch from the second patch.

9. The microwave radiating element according to claim 8, wherein the means for separating the first patch from the second patch comprises an air film.

10. The microwave radiating element according to claim 8, wherein the means for separating the first patch from the second patch comprises a layer of dielectric material.

11. The microwave radiating element according to claim 8, wherein the first and second feeders are coaxial lines.

12. The microwave radiating element according to claim 8, wherein the first and second feeders are each connected to a center of one of the straight sides of the respective first and second patches.

13. The microwave radiating element according to claim 8, wherein the first and second feeders are microstrips.

14. The microwave radiating element according to claim 8, further comprising at least one further patch located above the second patch.

* * * * *